US005429575A

United States Patent [19]

Armour et al.

[11] Patent Number: 5,429,575

[45] Date of Patent: Jul. 4, 1995

[54] CIGARETTE FILTER MANUFACTURE

[75] Inventors: Richard R. Armour; Anthony R. Brown; Kenneth B. Carter; Peter A. Clarke, all of Saunderton; Kevin R. Fincham, Coventry, all of England; Albert D. Seim, II, Richmond, Va.

[73] Assignee: Molins PLC, Bucks, England

[21] Appl. No.: 872,047

[22] Filed: Apr. 22, 1992

[30] Foreign Application Priority Data

Jan. 16, 1992 [GB] United Kingdom ..... 9200904

[51] Int. Cl.[6] ..... B65H 51/00; B65H 51/30; B65H 51/32

[52] U.S. Cl. ..... 493/48; 493/4; 57/90; 57/279; 57/333; 57/350; 406/153; 226/97

[58] Field of Search ..... 226/97; 406/153; 57/90, 57/279, 333, 350; 254/134.4; 493/4, 48, 42–46, 50, 303, 941

[56] References Cited

U.S. PATENT DOCUMENTS 3,971,695 7/1976 Block .
4,332,130 6/1982 Gasser ..... 226/97
4,358,226 11/1982 Nagata ..... 406/153
4,390,031 6/1983 Berger .
4,411,388 10/1983 Muck ..... 406/153
4,422,565 12/1983 Reba ..... 406/153
4,676,769 6/1987 Bahr ..... 493/48
4,747,814 5/1988 Berger .

FOREIGN PATENT DOCUMENTS 1094986 12/1967 United Kingdom .
1269974 4/1972 United Kingdom .
2118982 11/1983 United Kingdom .

*Primary Examiner*—Jack W. Lavinder
*Attorney, Agent, or Firm*—Antonelli, Terry, Stout & Kraus

[57] ABSTRACT

In a cigarette filter rod manufacturing plant at least one tow bale (6; 108) is located in a position remote from the corresponding tow opening machine (2; 100) and a conveying system (10; 112) is provided for transporting the tow to the machine. In a preferred arrangement the conveying system comprises a pneumatic duct (10) in which the tow is conveyed with the assistance of air movers (12). Removing the tow bales from the vicinity of the machines, preferably to a common area, allows flexibility in laying out a production floor and provides easy access for replacement of the bales.

30 Claims, 5 Drawing Sheets

CIGARETTE FILTER MANUFACTURE

This invention relates to cigarette filter manufacture, and in particular to a system for conveying a stream of tow to a filter making machine.

Cigarette filter rod is commonly produced from a stream of tow delivered to a continuous rod making machine. Prior to its introduction into the rod making part of the machine the tow is subjected to a stretching or "opening" action in a tow opening machine linked to the rod maker. The tow opening machine usually receives a continuous stream of tow from an adjacent bale, the path of the stream of tow between the bale and the machine being defined by one or more guide means such as rollers over which the stream passes.

According to one aspect of the invention apparatus for manufacturing cigarette filter rod comprises a machine for producing cigarette filter rod from a stream of tow, a source of tow remote from the machine, and a conveying system for conveying a stream of tow from the source to the machine. The conveying system preferably includes means for transporting the tow, or at least for assisting its conveyance. The transporting means may be adapted for conveying tow over relatively long distances, e.g. several meters or more, so that the source of tow can be located well away from the machine, and could be in a different room or building or on a different floor.

In a preferred embodiment the apparatus includes a pneumatic conveying system in which conveyance of the tow is effected or assisted by pneumatic means. Preferably the system includes a pneumatic duct through which the stream passes. Preferably the duct includes one or more air conveying means for conveying the stream in the duct and/or for providing an air bearing for the stream of tow as it is conveyed through the duct. The or each conveying means may be an air admitting means and may comprise an air mover. The air conveying means is preferably arranged so as to provide an air flow through the duct which is substantially parallel to the duct and which preferably inhibits any twisting of the stream of tow as it is conveyed through the duct. More generally, the air flow through the duct is preferably laminar although turbulent flow is not excluded and in particular the flow may be turbulent in some regions or conditions even when it is laminar in other regions or conditions.

Where the transporting means is pneumatic, conveying air may be generated by pressure air or by suction. Thus the air flow in a pneumatic duct could be produced by blowing air directly into the duct, either with or without substantial entrainment of ambient air (e.g. by using an air mover), or by applying suction to the duct. In either case the positions at which the air pressure or suction is applied may be intermediate the ends of the duct as well as or instead of at the upstream or downstream end of the duct respectively.

The air conveying means may be arranged so that conveying air flow through the duct is continuous and constant, or intermittent (e.g. pulsed or operative only during initial threading of the tow stream), or variable according to operating conditions (e.g. tow speed).

Where the transporting means comprises a duct, this preferably extends from a position adjacent the source to a position adjacent the machine, and may include air conveying means (e.g. an air mover or other air admitting means) adjacent its inlet end and further such means adjacent its outlet end. Additional intermediate air conveying means may be provided. Preferably means are provided for regulating the flow of air at the air conveying means, and in particular for providing increased air flow at selected air conveying means (e.g. that adjacent the outlet end of the duct) and/or at selected times to one or more of the air conveying means (e.g. to all of the air conveying means during initial threading of the duct with a stream of tow). Means may also be provided for controlling the air flow in accordance with the speed of the tow opening machine and/or in accordance with tow tension (e.g. as detected by a suitable sensor over which the tow passes).

In a preferred arrangement the duct is circular in cross-section. Alternatively, the duct could be non-circular, e.g rectangular, and particularly in this case may assist in maintaining the tow in ribbon-like form and in a defined orientation. The duct could include means for twisting the tow (which may comprise a twist in the duct itself) so as to present the tow in a defined orientation, e.g. at its outlet end.

The tow transporting means could comprise an endless band conveyor for the tow. This conveyor could be provided with suction to assist conveyance of the tow.

The source of tow may be a conventional bale of tow. Placement of a tow bale in a position remote from a filter rod making machine gives flexibility in laying out a production environment, particularly where there are several such machines. According to a further aspect of the invention there is a plurality of machines for producing cigarette filter rod and a plurality of sources of tow located remote from the machines, the conveying system being arranged to convey a stream of tow to each machine from a respective source. The sources of tow may be located in adjacent positions conveniently positioned for access, e.g. by fork lift trucks delivering bales of tow.

Reference herein to a machine for producing cigarette filter rod or similar wording should be taken to include a reference to such a machine including also a tow opening machine unless the context requires otherwise.

According to another aspect of the invention a pneumatic conveying system for a tow of fibrous material comprises a duct, through which a stream of the tow may be conveyed, and air flow means for assisting conveyance of the tow through the duct, the air flow means comprising a face communicating with the inside of the duct and at least one outlet in the face for directing a stream of air in a direction substantially parallel to the conveyance direction of the duct. Preferably the air flow means comprises air admitting means, preferably an air mover. Preferably the outlet directs a stream of air adjacent the inner periphery of the duct. There may be a series of such outlets arranged around the inner periphery of the duct, preferably at substantially equal spacings.

Said face of the air flow means may be arranged at right angles to the conveyance direction of the duct, and may therefore effectively comprise a step in the inner periphery of the duct. In one preferred arrangement, wherein the duct is circular in cross-section, said face is annular and carries a series of outlets. In this arrangement the air flow means may be interposed between upstream and downstream sections of the duct and provide a relatively slight restriction in the diameter of the duct. Where said face provides a step at a downstream portion of the air flow means the upstream part of said means preferably includes a tapered lead-in for the stream of tow.

Each of the aspects of the invention may be embodied in common apparatus, i.e. the pneumatic conveying system may be incorporated in apparatus for making cigarette filter rod.

The invention will be further described, by way of example only, with reference to the accompanying diagrammatic drawings, in which.

Figure 1:
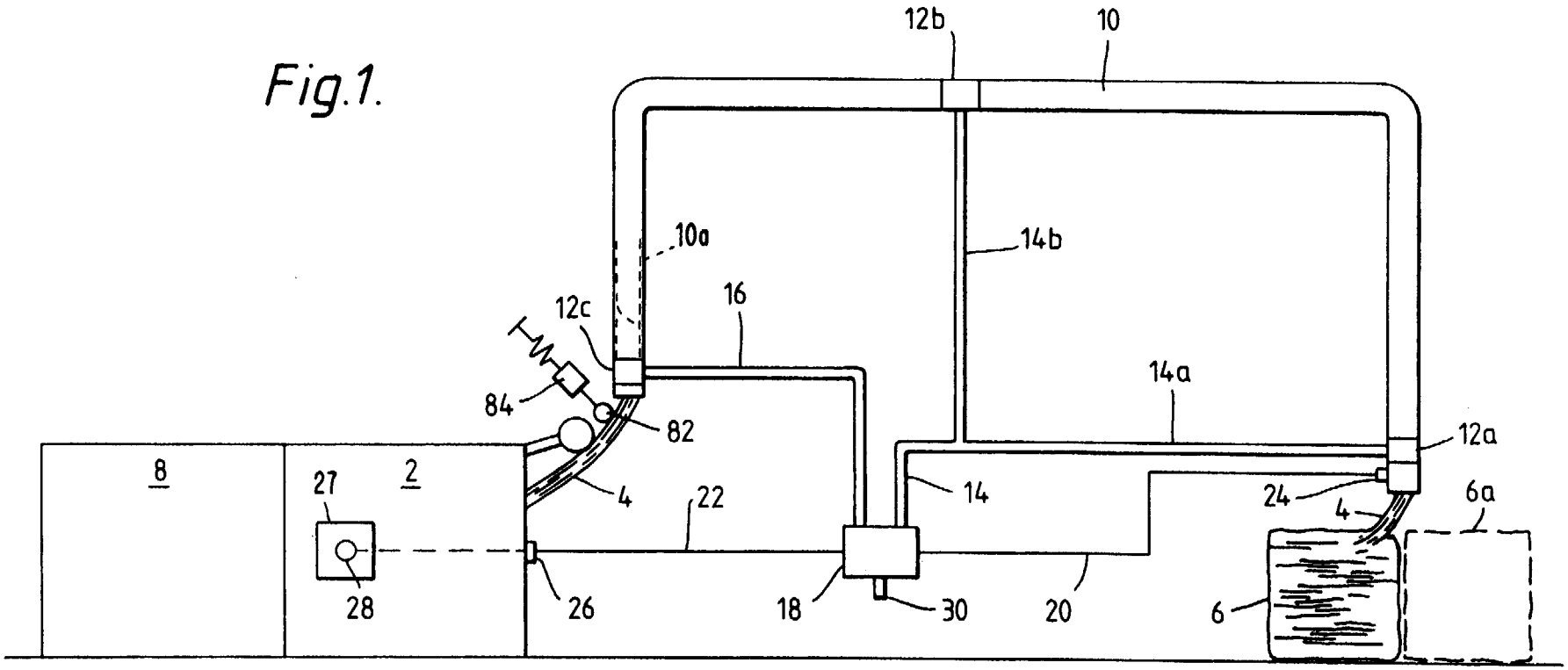
FIG. 1 is a side elevation of a tow conveying system.

FIG. 1 shows a tow opening machine 2 arranged to receive a stream of tow 4 from a remote tow bale 6. The machine 2 is linked to a filter rod making machine 8. The machines 2 and 8 may be Molins T05 and PM5N machines respectively.

The tow stream 4 is conveyed from the bale 6 to the machine 2 by way of a pneumatic duct 10. An air mover 12*a* is located at the inlet end of the duct 10: similar air movers 12*b* and 12*c* are respectively located in the upper horizontal run of the duct and at its outlet end. The air movers 12*a* and 12*b* are supplied with air by way of an air line 14 which branches into lines 14*a* and 14*b* respectively. The air mover 12*c* is supplied with air from a line 16. Supply of air to the air lines 14 and 16 is controlled by an electro-pneumatic control unit 18. Signal lines 20 and 22 connect the unit 18 with manual switches 24 and 26 respectively located near the inlet end of the duct 10 and the tow opening machine 2. The line 22 also connects to an automatic control unit 27 incorporating a switch 28 controlled by operation of the tow opening machine 2. The unit 27 may comprise a tachogenerator responding to speed of the machine 2. An air pressure source (not shown) is connected to the control unit 18 by way of a supply line 30.

Figure 2:
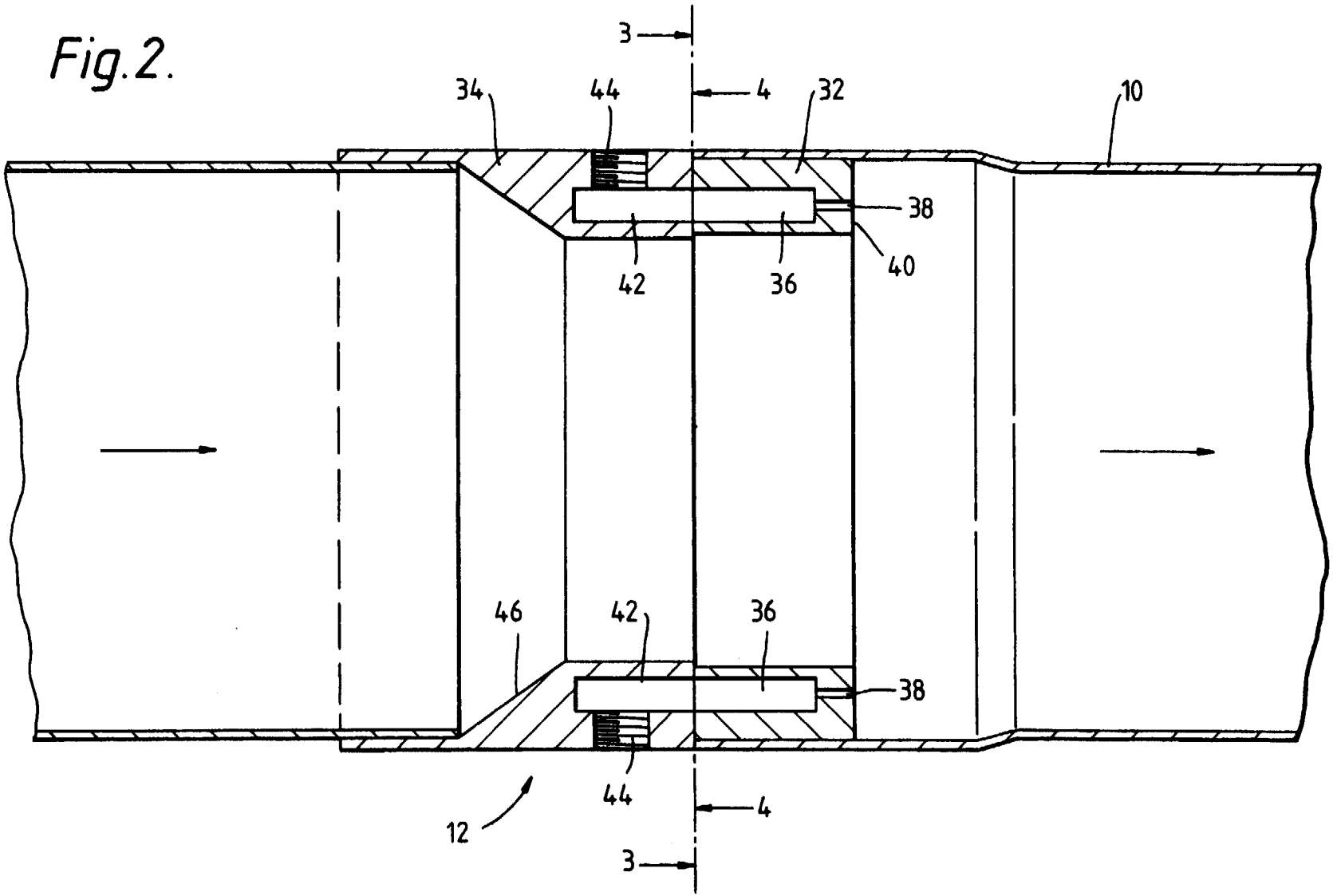
FIG. 2 is a longitudinal sectional view of an air mover usable in the system of FIG. 1.
Figure 3:
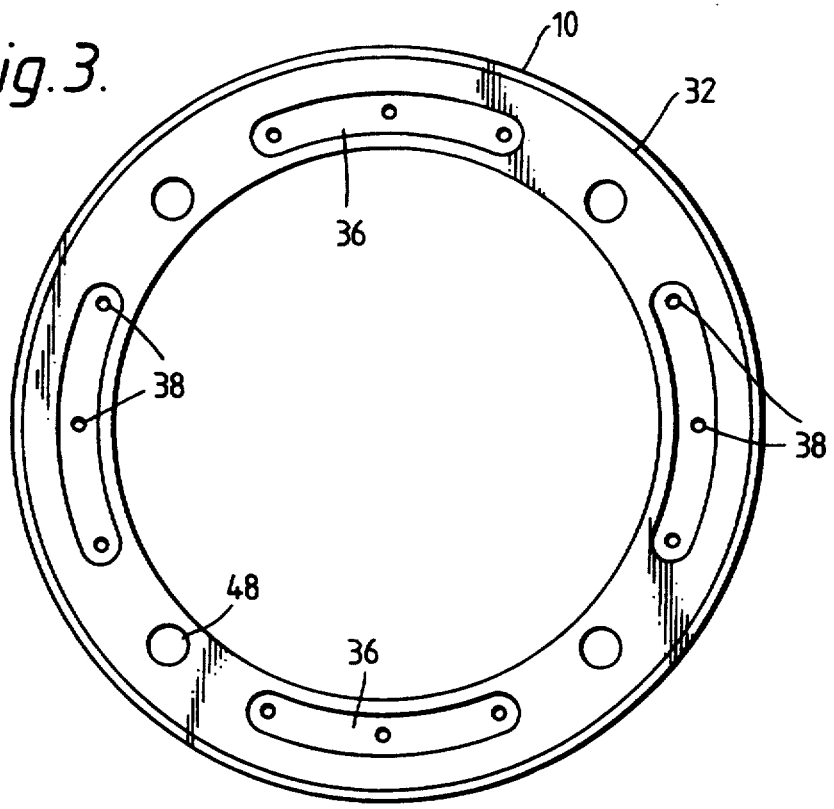
FIG. 3 is a transverse sectional view on the section 3—3 in FIG. 2.
Figure 4:
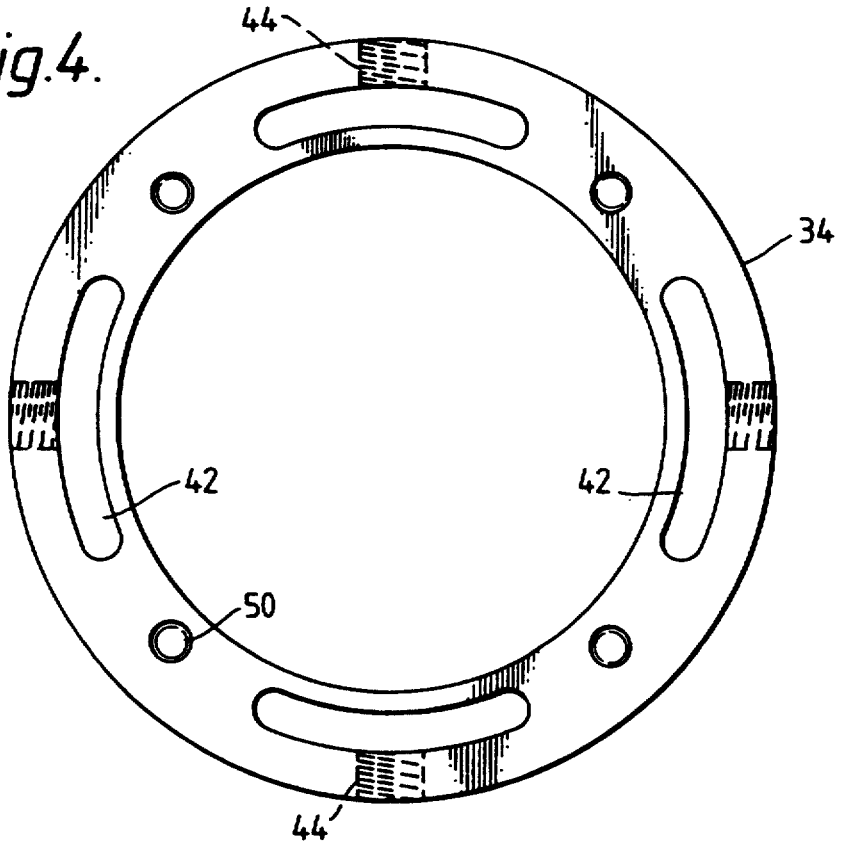
FIG. 4 is a transverse sectional view on the section 4—4 in FIG. 2.

An air mover 12 is shown in more detail in FIGS. 2–4 and comprises two abutting annular members 32, 34 which are interposed between separate sections of the duct 10. The downstream member 32 has four arcuate chambers 36, each of which communicates with three holes 38 extending through the downstream face 40 of the member 36 (i.e. there are twelve holes 38 in total). The upstream member 34 similarly has four arcuate chambers 42, in register with the chambers 36 in the member 32, each of which connects with a radial bore 44. Each of the bores 44 is connected with the air supply line associated with the air mover 12 (e.g. line 14*b* for the air mover 12*b* in FIG. 1 ). The member 34 has an annular tapered lead-in face 46 at its upstream end. The members 32 and 34 are connected together by bolts (not shown) passing through holes 48 in member 32 into threaded holes 50 in member 34.

In operation, the air movers 12*a*, 12*b* and 12*c*, when supplied with air under pressure, produce an air flow in the duct 10 which causes the tow stream to be conveyed from the bale 6 to the tow opening machine 2 substantially without twisting. The arrangement of the outlet holes 38 in a ring near the inner periphery of the duct 10 is considered significant in establishing a satisfactory conveying air flow. It is believed that a laminar flow, at least in the region of the air movers 12, is beneficial in this respect although the flow may be turbulent in certain other positions and/or conditions.

Figure 5:
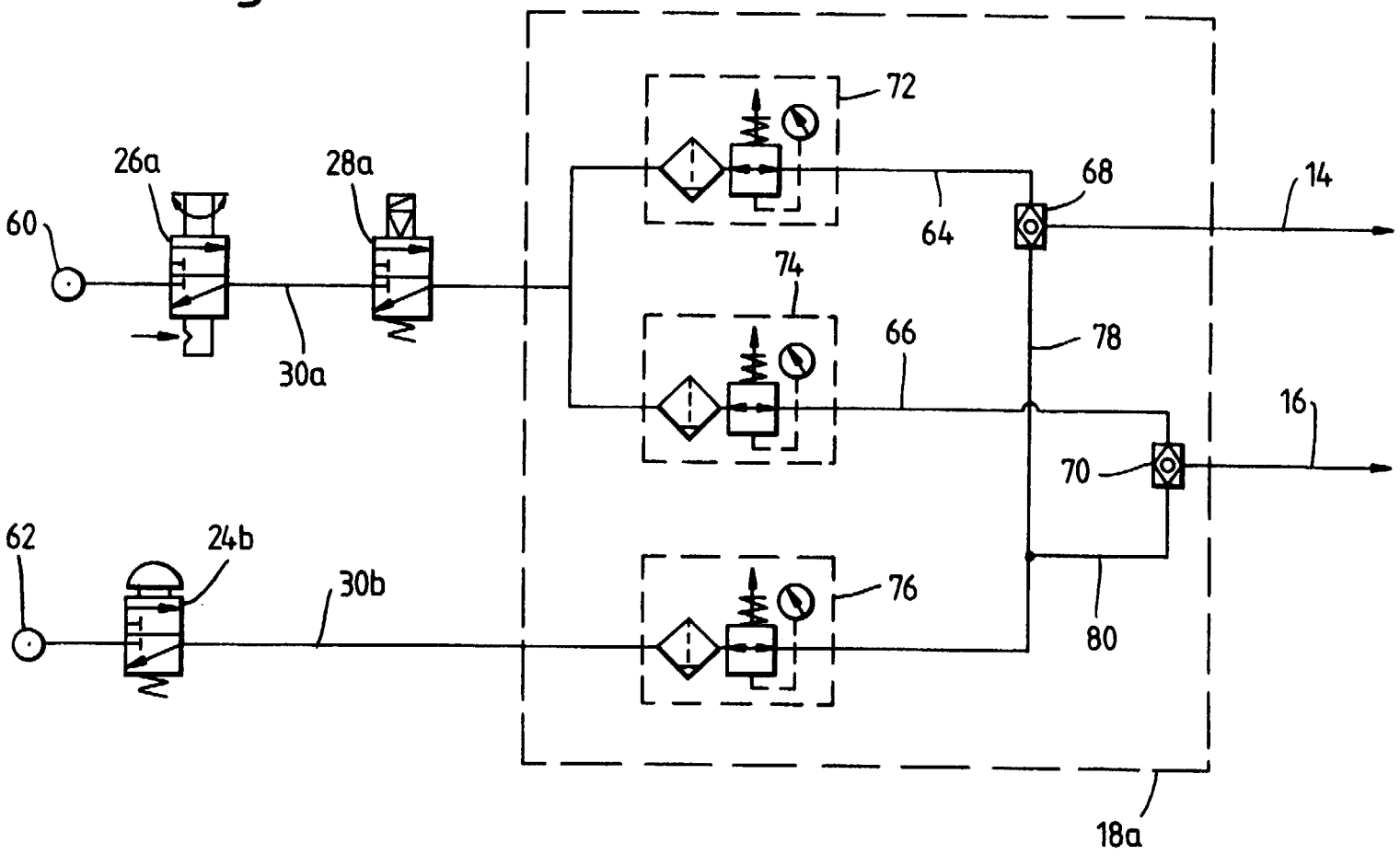
FIG. 5 is a schematic representation of an air control circuit usable in the system of FIG. 1.

FIG. 5 shows schematically a control system which operates in principle in the same way as that shown in FIG. 1. The air pressure lines 14, 16 are connected to a control unit 18*a* for supply of air from pressure air lines 60, 62 (which may be connected to a common pressure source). The line 60, which is located adjacent the tow opening machine 2, is connected to the unit 18*a* via an air line 30*a*; the line 62, which is located adjacent the inlet end of the duct 10, is connected to the unit 18*a* via an air line 30*b*. The line 30*a* carries a manual valve 26*a* and an automatic valve 28*a* , both located at the tow opening machine 2. The line 30*b* carries a manual hold-on valve 24*b*, located at the inlet end of the duct 10.

Within the unit 18*a* the line 30*a* branches into lines 64 and 66 leading to inlets of shuttle valves 68 and 70, respectively connected to the lines 14 and 16. Pressure regulators 72, 74 are respectively arranged in the lines 64 and 66. The line 30*b* extends into the unit 18*a* and contains a further pressure regulator 76, downstream of which the line branches into lines 78, 80 respectively leading to second inlets of the shuttle valves 68, 70. Each of the valves 68, 70 responds to pressure at its inlet to admit air from one or other of the inlets (but not both) for passage to the outlet.

The sequence of events in establishing conveyance of a stream of tow through the duct 10 is as follows. The end of the tow stream 4 is manually introduced into the inlet end of the duct 10 and the switch 24 or valve 24*a* operated. This causes air at a relatively high pressure (set by regulator 76) to be supplied to the air movers 12*a*, 12*b* and 12*c* by way of lines 14 and 16. The relatively high pressure and consequent relatively high flow rate from the air movers is effective in reliably conveying the tow stream to the tow opening machine 2. Release of the switch 24 or valve 24*a* closes the air line 30*b*.

When the leading end of the tow stream 4 has reached the outlet end of the duct 10 an operator at the machine 2 will thread it as necessary and operate the switch 26 or manual valve 26*a*. Running of the machine 2 opens the automatic switch 28 or valve 28*a*, thereby admitting air to lines 14 and 16 by way of the lines 64 and 66. The shuttle valves 68 and 70, previously opened by pressure in lines 78 and 80, are switched by pressure in the lines 64 and 66.

The pressure regulator 74 is set for a somewhat higher pressure than is the pressure regulator 72: this is because we have found it advantageous to provide the air mover adjacent the exit of a duct with an increased flow. The pressure regulator 76, which controls pressure admitted to the lines 14 and 16 on start-up or priming only, is set at a still higher level. If the tow opening machine 2 is stopped for any reason the automatic switch 28 or valve 28*a* closes, thereby stopping the flow of air to the air movers and consequent conveyance of the tow stream 4.

In the system of FIG. 1 we have found that with a distance between the tow opening machine 2 and the bale 6 of up to 20 meters the air mover 12*b* is preferably located about half way along the horizontal run of the duct 10. With greater distances between the machine 2 and bale 6 it may be advisable to provide more than one intermediate air mover. Similarly, the vertical lengths of the duct 10 are typically about 2.5 meters: with longer vertical lengths, particularly where the tow stream is being conveyed upwards, one or more further air movers may be required in the vertical part of the duct. The internal radii of the bends shown in the duct 10 may be about 300 mm. The duct 10 could include lateral (i.e. horizontal) bends as well as vertical bends. Although it is preferred that there should be a minimum amount of twisting of the tow stream as it is conveyed through the duct, some twisting in the vicinity of the air mover 12*c* or in the adjacent vertical run of the duct may be allowed, e.g. to orientate the tow stream for correct entry to a tow opening machine facing a direction which differs from that of the machine 2. For this purpose, the duct 10 could have a rectangular section including a twist, as indicated by the dotted lines 10*a* in FIG. 1.

The bale 6 and the tow opening machine 2 need not be located in the same room or at the same level. Various configurations of duct with appropriate placement of air movers may be provided, and the duct may be readily configured to convey tow from a remote bale. For example, several bales servicing several filter making machines may be located together so that transport of relatively heavy bales to a common area is facilitated. This releases valuable space in the production area containing the filter making machines, not only because space is no longer required for the bales themselves but also because provision of access for transporting the bales is no longer required.

In the system of FIG. 1 the duct 10 may typically have an internal diameter of about 100 mm, the minimum internal diameter of the air movers 12 being about 75 min. The radial width of the slots 36, 42 may be about 6mm, and the diameter of the hole 38 may be about 0.75 mm. Typically pressure for the regulators 72 and 74 is in the range 45–50 psi (3–3.5 bar) and that for the regulator 76 is in the range 50–55 psi (3.5–4 bar). Typical air usage during normal conveyance in a system with three air movers is 16 cubic feet/minute (0.45 cubic meters/minute).

Additional air flow is required during start-up or priming since the air flow then must be sufficient to convey the tow through the duct. After the tow is connected at the tow opening machine the air flow acts more as an air bearing for the tow, so that air flow for conveyance may be reduced.

The pressure regulators 72, 74 and 76 are intended to be adjusted by hand. Alternatively, they could be automatically controlled in response to a speed signal from the tow opening machine, e.g. from the unit 27. Thus, the flow from the air movers could be increased with speed of the tow opening machine.

Tension in the tow at the exit from the duct 10 depends on the relationship between the conveyance rate of the tow through the duct and the speed of the tow opening machine 2. The air movers 12 may be automatically adjusted to control tow tension. For this purpose the tow is arranged to pass over a small bar or roller 82 near the outlet end of the duct 10. The roller 82 is carried by a resilient mounting arranged so that the roller is deflected by an amount which depends on tension in the tow. The mounting incorporates a strain gauge 84 provided for measuring the deflecting force generated by the tow and hence providing a measure of the tension in the tow. A signal derived from the output from the strain gauge 84 may be used to control the pressure regulators, particularly the regulator 74 and/or the regulator 72. Controlling the tow tension in this way may overcome problems caused by machine acceleration (or other condition) affecting the tow tension and thus the characteristics of the finished filter rod.

A new bale 6*a* may be placed alongside the old bale 6 ready for continuous feeding, e.g. by tying the trailing end of the old bale to the leading end of the new bale. Where this is done it may be advisable to provide a splice detector near the tow opening machine to prevent the splice or tied ends of the tow streams passing through the machine.

The duct 10 may be provided with a tow dust extractor so that air exhausting at least in the vicinity of the tow opening machine 2, does not carry small particles of tow which may be regarded as injurious to health.

Figure 6:
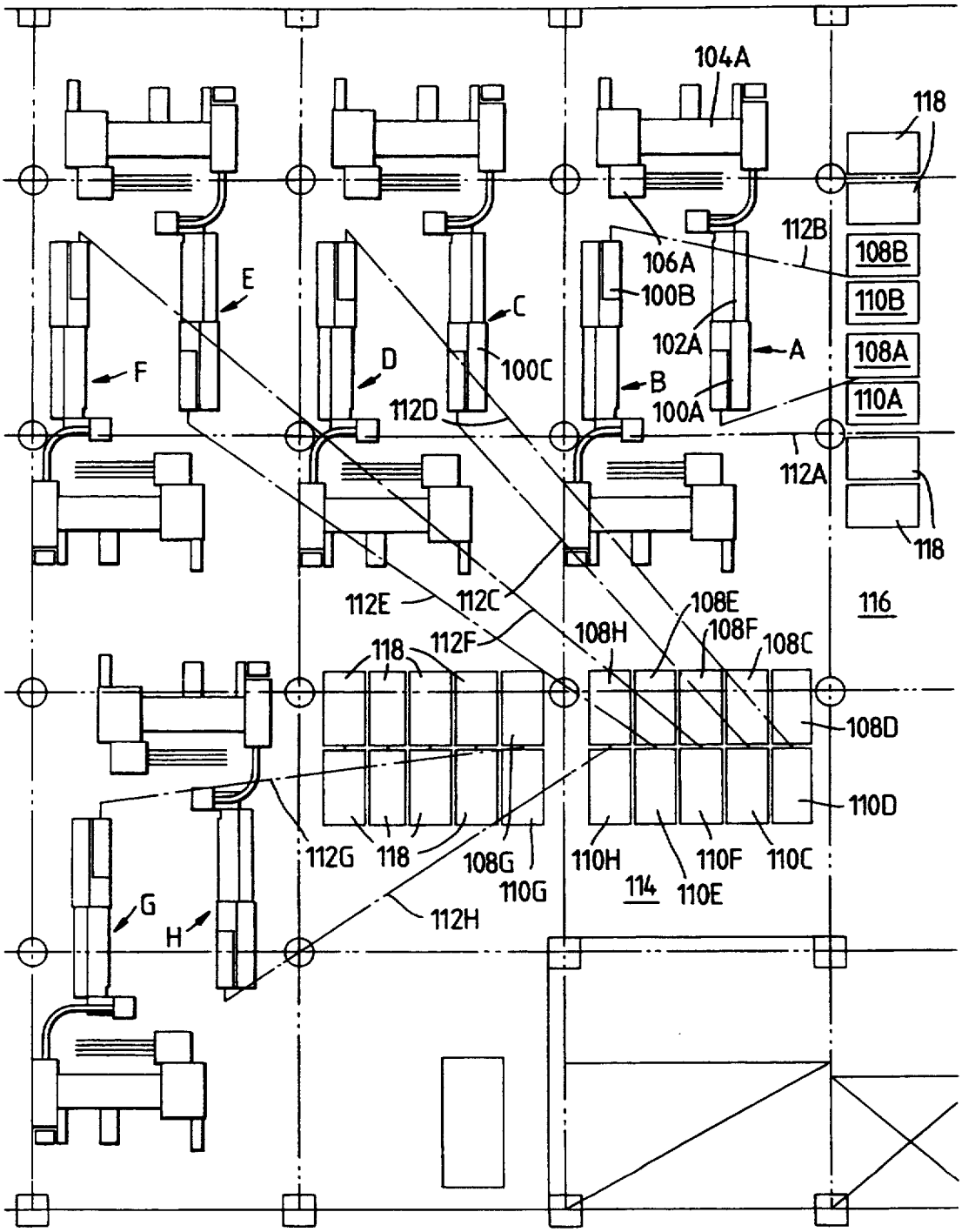
FIG. 6 is a plan view of a group of filter making and associated machines.

FIG. 6 shows part of a filter production floor in a cigarette factory. The floor includes eight groups of machines A–H. The machine group A includes a tow opening machine 100A, a filter rod making machine 102A, a tray-based filter reservoir and delay line conveyor 104A, and a pneumatic filter distribution unit 106A. Each of the other groups B–H has similar components, designated by the appropriate suffix, e.g. 100B, 100C etc. Each group, and in particular each tow opening machine 100A–H, is linked by a pneumatic tow conveying duct to a location adjacent a respective pair of tow bales 108A, 110A–108H, 110H. The respective ducts are indicated by the lines 112A–H in the drawing: these lines do not necessarily indicate the exact paths of the ducts which may need to be other than straight to avoid obstructions. Each duct 112A–H has an inlet end adjacent two bale positions (108, 110) so that a new bale may be placed in position prior to expiry of the old bale. The bales 108, 110 are conveniently located adjacent gangways 114, 116 to facilitate replacement of bales. The bales 118 service groups of machines not shown in the drawings. In the alternative, the lines 112A–112H in FIG. 6 could represent endless band suction conveyors, in a system in which endless band conveyors are employed in place of pneumatic ducts to convey filter tow to the filter rod making machines.

We claim:

1. Apparatus for manufacturing cigarette filter rod, comprising a machine for producing cigarette filter rod from a stream of tow; and a conveying system for conveying a stream of tow to the machine at which a replaceable source of tow may be located, including pneumatic means having a duct through which the stream of tow passes in use for assisting conveyance of the tow, said duct including air conveying means for generating an air flow in the duct, means for regulating the air flow generated by said air conveying means, and means for sensing tension in the stream of tow between the source and the machine, said regulating means including means responsive to said sensing means for regulating the flow generated by said air conveying means.

2. Apparatus as claimed in claim 1, wherein said sensing means is located between the downstream end of the duct and the machine.

3. A system for manufacturing cigarette filter rod, comprising a plurality of machines for producing cigarette filter rod disposed in a specified area, a plurality of sources of tow located remote from the machines and outside said specified area, and a pneumatic conveying system arranged to convey a stream of tow to each machine from a respective source, wherein said sources are located in adjacent positions remote from said machines.

4. A system as claimed in claim 3, wherein said conveying system comprises a plurality of ducts extending from said adjacent positions to said plurality of machines.

5. A system as claimed in claim 4, wherein each duct includes plural air conveying means spaced along the length of the duct.

6. A system as claimed in claim 5, wherein said air conveying means includes means for admitting air to the duct.

7. A system as claimed in claim 6, wherein the air admitting means includes an air mover.

8. A system as claimed in claim 5, wherein each air conveying means is adapted to generate an air flow extending substantially parallel to the duct.

9. A system as claimed in claim 5, including means for regulating the air flow generated by said air conveying means.

10. A system as claimed in claim 9, wherein said regulating means includes means for providing increased air flow at selected times.

11. A system as claimed in claim 9, wherein said air conveying means includes spaced means for admitting air to said duct, said regulating means including means for providing a greater air flow to a respective one of said spaced means than to the other.

12. A system as claimed in claim 9, including means for sensing a speed of said machine, said regulating means including means responsive to said sensing means for regulating the flow generated by said air conveying means.

13. A system as claimed in claim 5, wherein each air conveying means comprises a face communicating with the inside of the duct and at least one outlet in the face for directing a stream of air in a direction substantially parallel to the conveyance direction of the duct.

14. A system as claimed in claim 13, wherein said outlet is arranged to direct a stream of air adjacent the inner periphery of the duct.

15. A system as claimed in claim 14, wherein the air conveying means comprises a series of outlets arranged around the inner periphery of the duct.

16. A system as claimed in claim 14, wherein said face of the air conveying means is arranged substantially at right angles to the conveyance direction of the duct and comprises a step in the inner periphery of the duct.

17. A system as claimed in claim 13, wherein the duct is circular in cross section and said face is annular and carries a series of said outlets.

18. A system as claimed in claim 4, wherein each duct extends from a position adjacent said source to a position adjacent said machine.

19. A system as claimed in claim 18, wherein each duct includes at least two air admitting means spaced along its length.

20. A system as claimed in claim 19, wherein at least one of said air admitting means is located at a position intermediate the ends of the duct and includes an air mover.

21. A systems as claimed in claim 3, wherein each of said sources comprises at least one bale of tow.

22. Apparatus for manufacturing cigarette filter rod, comprising a machine for producing cigarette filter rod from a stream of tow, means for sensing a speed of said machine, and a conveying system for conveying a stream of tow to the machine from a source of tow at a location remote from the machine and at which a replaceable source of tow may be located, said conveying system including path defining means including a pneumatic duct, extending from a position adjacent said remote location to a position adjacent the machine and through which the stream of tow passes in use, air conveying means for generating an air flow in the duct, and regulating means responsive to said sensing means for regulating the air flow generated by said air conveying means.

23. Apparatus as claimed in claim 22, wherein said path defining means extends over a distance of at least 5 meters.

24. Apparatus as claimed in claim 23, wherein said duct includes a portion adjacent said location having a vertically upward component, and means for admitting pressure air to said portion for conveyance of tow from the source into the duct.

25. Apparatus as claimed in claim 24, wherein said duct further includes an overhead portion connected to said portion adjacent said location, said overhead portion including at least one further means for admitting pressure air for conveyance of tow through the duct.

26. Apparatus as claimed in claim 22, wherein said replaceable source comprises at least one bale of tow.

27. Apparatus as claimed in claim 22, wherein a tow opening machine is interposed between said cigarette filter rod producing machine and said location and is disposed at the downstream end of said conveying system.

28. A system for manufacturing cigarette filter rod comprising a plurality of machines, disposed in a specified area, for producing cigarette filter rod from streams of tow, and a conveying system for conveying respective streams of tow to respective machines from respective sources of tow disposed at a location outside and remote from said specified area and at which a replaceable source of tow may be located, said conveying system including endless band conveyors extending from adjacent positions at said remote location to positions adjacent each machine.

29. Apparatus as claimed in claim 28, including means associated with at least one endless bond conveyor for providing suction to assist conveyance of the tow.

30. Apparatus for manufacturing cigarette filter rod, comprising a machine for producing cigarette filter rod from a stream of tow; and a conveying system for conveying a stream of tow to the machine from a source of tow at a location remote from the machine and at which a replaceable source of tow may be located, including pneumatic means, having a duct through which the stream of tow passes in use, for assisting conveyance of the tow, wherein the duct includes means for twisting a tow stream in the duct in such a way as to present the stream in a defined angular orientation relative to its longitudinal axis at a predetermined position.

* * * * *